US007299576B2

(12) United States Patent
Martin et al.

(10) Patent No.: US 7,299,576 B2
(45) Date of Patent: Nov. 27, 2007

(54) VENDING MACHINE ADVERTISING APPARATUS AND METHOD

(75) Inventors: John D. Martin, Watertown, WI (US); Dave M. Kohlhoff, Waterloo, WI (US)

(73) Assignee: CM-Glo, LLC, Watertown, WI (US)

( * ) Notice: Subject to any disclaimer, the term of this patent is extended or adjusted under 35 U.S.C. 154(b) by 273 days.

(21) Appl. No.: 11/018,663

(22) Filed: Dec. 21, 2004

(65) Prior Publication Data

US 2005/0107912 A1 May 19, 2005

Related U.S. Application Data

(63) Continuation of application No. 10/301,980, filed on Nov. 22, 2002.

(60) Provisional application No. 60/356,044, filed on Feb. 11, 2002.

(51) Int. Cl.
*G09F 13/22* (2006.01)

(52) U.S. Cl. ..... 40/544; 221/8

(58) Field of Classification Search ..... 40/544, 40/584; 221/8; 700/231, 232; 315/169.3
See application file for complete search history.

(56) References Cited

U.S. PATENT DOCUMENTS

| | | | |
|---|---|---|---|
| 3,757,322 | A | 9/1973 | Barkan et al. |
| 4,532,395 | A | 7/1985 | Zukowski |
| 4,638,360 | A | 1/1987 | Christopher et al. |
| 4,740,781 | A | 4/1988 | Brown |
| 4,893,115 | A | 1/1990 | Blanchard |
| 4,970,811 | A | 11/1990 | Chang |
| 5,293,098 | A | 3/1994 | Brownell |
| 5,422,547 | A | 6/1995 | Brownell |
| 5,451,842 | A | 9/1995 | Chien |
| 5,525,908 | A | 6/1996 | Brownell |
| 5,533,289 | A | 7/1996 | Hoffman |
| 5,565,739 | A | 10/1996 | Brownell |
| 5,572,817 | A | 11/1996 | Chien |
| 5,621,991 | A | 4/1997 | Gustafson |
| 5,814,947 | A | 9/1998 | Brownell |
| 5,831,862 | A | 11/1998 | Hetrick et al. |
| 5,861,875 | A | 1/1999 | Gerpheide |
| 5,957,564 | A | 9/1999 | Bruce et al. |
| 5,958,573 | A | 9/1999 | Spitler et al. |
| 5,977,888 | A | 11/1999 | Fujita et al. |
| 6,014,116 | A | 1/2000 | Haynes et al. |
| 6,034,481 | A | 3/2000 | Haynes |
| 6,060,838 | A | 5/2000 | Cantoni et al. |
| 6,118,435 | A | 9/2000 | Fujita et al. |
| 6,144,164 | A | 11/2000 | Ito |
| 6,195,924 | B1 | 3/2001 | Rudick et al. |
| 6,297,810 | B1 | 10/2001 | Anderson |
| 6,465,969 | B1 | 10/2002 | Murasko et al. |
| 6,670,873 | B2 | 12/2003 | Inada et al. |
| 2001/0042329 | A1 | 11/2001 | Murasko et al. |
| 2002/0107610 | A1 | 8/2002 | Kachler et al. |

*Primary Examiner*—Gary C. Hoge
(74) *Attorney, Agent, or Firm*—Michael Best & Friedrich

(57) ABSTRACT

In some embodiments of the present invention, a vending machine display apparatus and method includes a controller, a display electrically coupled to the controller and adapted to be coupled to the vending machine in a location externally visible on the vending machine, and a power line coupled to the display and adapted to supply power to the display. The display can be associated with the user-manipulatable control and/or with a product in the vending machine dispensed by operation of the user-manipulatable control. In some embodiments, the display is responsive to the controller by changing graphics and/or text displayed by the display.

20 Claims, 7 Drawing Sheets

VENDING MACHINE ADVERTISING APPARATUS AND METHOD

RELATED APPLICATIONS

This is a continuation of U.S. patent application Ser. No. 10/301,980 filed on Nov. 22, 2002. Priority is also claimed to U.S. Provisional Patent Application No. 60/356,044 filed on Feb. 11, 2002. The entire contents of U.S. patent application No. 10/301,980 and U.S. Provisional Patent Application No. 60/356,044 are incorporated herein by reference.

FIELD OF THE INVENTION

This invention relates generally to displays, and more particularly to vending machine displays.

BACKGROUND OF THE INVENTION

Vending machines often utilize displays to advertise and sell products. These displays typically are in the form of still graphics, pictures, or text on the viewable surfaces of the vending machine.

Many different types of vending machines exist for housing and selling many different types of products. Examples of such vending machines include soda vending machines, cigarette dispensing machines, snack/candy machines, etc. Such vending machines often utilize displays on all or a large amount of their viewable surfaces to advertise their products. Such displays can be located on the front surface, side surfaces, and top surface of the vending machine in locations where the consumer can effectively see the product advertisements. For example, beverage vending machines typically include large displays showing still graphics or pictures of the beverages sold on some or all viewable surfaces of the beverage vending machine.

Some vending machines contain mixed products. Such vending machines can include unrelated products such as soda, candy/snacks, food, cigarettes, toys, and personal items. These vending machines often utilize much smaller displays to advertise their products compared to vending machines that contain related products. In both types of vending machines, displays are often located adjacent to the dispensed product are often employed. These displays can include still graphics, pictures, or text individually relating to the dispensed products. In those cases where display and advertising space on a vending machine is at a premium, the ability to capture the consumer's attention with a display of any size is important.

In addition to the advertising and display needs of vending machines discussed above, several problems exist with conventional vending machines. Some conventional vending machines utilize lighted displays employing incandescent light bulbs for illumination. Incandescent light bulbs radiate heat during operation, which is often a problem when combined with the storage requirements of the products contained within the vending machines. For example, the individual cans or bottles contained within a beverage vending machine typically require refrigeration. Incandescent light bulbs located in soda vending machines can transfer heat into the refrigerated compartment of the machine. This decreases the overall efficiency of the refrigeration unit within the soda vending machine, which in turn causes the machine to draw more electricity to maintain the chilled environment within the machine. In addition, despite advances made in the field of light bulbs, the energy consumed to power light bulbs remains a significant part of the total energy required to run conventional vending machines.

A further problem with conventional vending machines that utilize incandescent light bulbs to illuminate their display surfaces is that these light bulbs are bulky and require a large amount of space in the vending machine. As a result, less space is allowed for the dispensed product for a given vending machine size, which can yield a lower profitability to the vending machine owner.

Yet another problem with conventional vending machines that utilize incandescent or fluorescent light bulbs to illuminate their display surfaces is that their design places inherent limitations on the location of illuminated displays within the vending machine and how the bulbs are used to light the displays of the vending machine. For example, the relatively large size of many light bulbs often requires them to be centrally located in the vending machine, or can otherwise limit the location and placement of illuminated displays on the vending machine.

SUMMARY OF THE INVENTION

Some embodiments of the present invention provide a vending machine display apparatus for a vending machine having user-manipulatable controls for dispensing products, the vending machine display apparatus comprising a controller; at least two displays electrically and releasably coupled to the controller and adapted to be coupled to the vending machine in respective locations externally visible on the vending machine, wherein each respective location is one of within and behind a user manipulatable control of the vending machine, each display removable independently of the other displays; and at least one power line coupled to the displays and adapted to supply power to the displays; the displays associated with the user-manipulatable controls and with products in the vending machine dispensed by operation of the user-manipulatable controls, the displays responsive to the controller by changing at least one of graphics and text displayed by the displays.

In some embodiments, a vending machine display apparatus for a vending machine having a plurality of user-manipulatable controls is provided, wherein each user-manipulatable control is operable to generate dispense of a product associated with the user-manipulatable control, and wherein the vending machine display apparatus comprises a plurality of displays each adapted to be removably coupled to the vending machine in respective locations independently of the other displays, wherein each respective location is one of within and behind a respective user manipulatable control of the vending machine; at least one controller releasably coupled to the plurality of displays, the at least one controller operable to generate animation upon the plurality of displays, at least two of the displays individually controllable by the at least one controller; and a plurality of power lines electrically coupled to the plurality of displays.

Some embodiments of the present invention provide a method of advertising products in a vending machine, wherein the method comprises supplying power to at least one display releasably coupled to a controller of the vending machine, each display associated with a corresponding user-manipulatable control on the vending machine; coupling each display to one of a location within the corresponding user-manipulatable control and behind the corresponding user-manipulatable control, each display individually removable from its location; controlling a supply of power to the at least one display via the controller; and individually controlling each display to generate animation thereon by controlling the supply of power thereto, the animation including an advertisement for a product dispensed by operation of the corresponding user-manipulatable control.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE FIGURES

The vending machine advertising apparatus and method according to the present invention is described with reference to the accompanying figures, which show some preferred embodiments of the present invention. However, it should be noted that the invention as disclosed in the accompanying figures is illustrated by way of example only. The various elements and combinations of elements described below and illustrated in the figures can be arranged and organized differently to result in embodiments which are still within the spirit and scope of the invention.

In the drawings, wherein like numerals indicate like parts.

DETAILED DESCRIPTION OF THE EMBODIMENT

Figure 1:
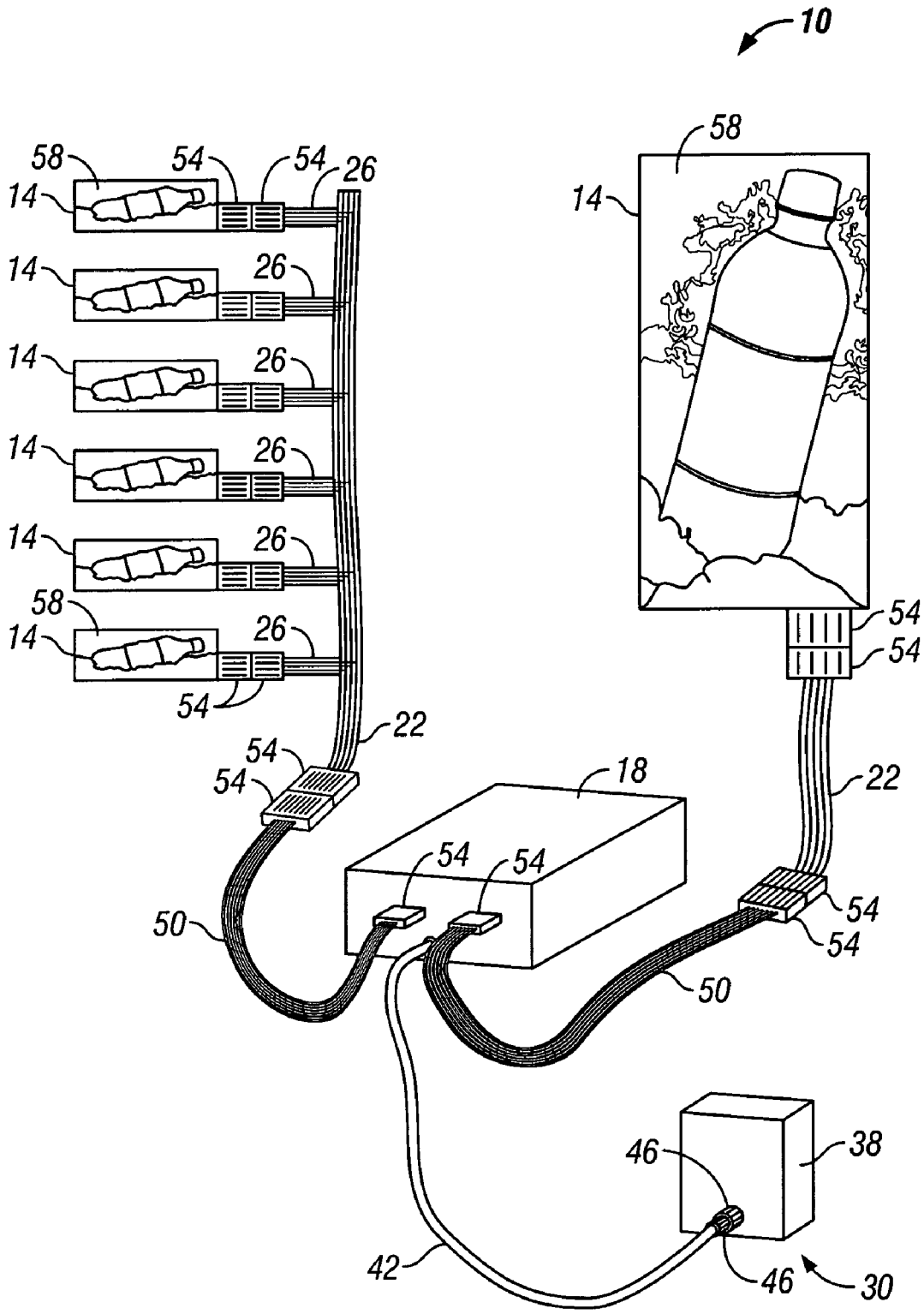
FIG. 1 is a schematic view of a vending machine advertising apparatus according to a first embodiment of the present invention.

With reference first to FIG. 1, a vending machine display apparatus 10 according to some embodiments of the present invention employs one or more displays 14, a controller 18 electrically connected to the displays 14 via suitable power wires 22, 26, and a power supply 30. Although the displays 14 can be of any type (including without limitation LED, LCD, CRT, and other display types), significant advantages are achieved by the use of electroluminescent ("EL") displays 14. Accordingly, the following description and accompanying figures are with reference to EL displays 14, but are understood to encompass displays of any other type.

Vending machines in which the display apparatus 10 according to the present invention can be employed include without limitation soda, juice, beer, liquor, coffee, cigarette, novelty items, ticket, candy, and food dispensing machines, and can even include video game machines and other entertainment machines. Soda vending machines 34 are illustrated in FIGS. 4A-4D as including various embodiments of the display apparatus 10, and are presented for purposes of illustration only.

The controller 18 of the display apparatus 10 illustrated in FIG. 1 can take a number of different forms, and preferably at least provide power to the displays 14 connected thereto. Although this power can be in AC or DC form, the controller 18 in the illustrated embodiment of FIG. 1 provides between about 40 volts and 240 volts AC to the displays 14, depending at least in part upon the size of the displays 14. The controller 18 in this embodiment receives 110-volt AC, 60 Hz line power from a junction box 38 (which can be located within the vending machine 34) via a power cord 42 and releasable plugs 46. In some embodiments, Dixie or Vendo style plugs are employed for either or both of these plugs 46. Alternatively, the controller 18 can be hard wired or spliced into the junction box 38 to receive the line power from the junction box 38. In the illustrated embodiment, the controller 18 internally converts the 110-volt AC, 60 Hz line power to between about 40 volts and 240 volts AC power usable by the EL displays 14. The controller 18 can also convert the line power frequency to between about 50 Hz and 2000 Hz, depending at least in part upon the desired brightness and illumination (e.g., animation) rate of the displays 14. In some embodiments, the controller 18 utilizes conventional rectifier and inversion circuitry, in addition to conventional transformer circuitry, to provide the voltage drop, current inversion, and frequency changes to the line power.

In some embodiments of the present invention, the controller 18 also includes a sequencer in order to provide the displays 14 with power at desired locations and times on the displays 14. Any conventional sequencer can be employed for this purpose. Such a sequencer can be employed to selectively illuminate one or more displays 14 (or portions of each display 14) in order to generate graphics or text animation of the displays 14. The process of animating an EL display via a sequencer is conventional and is not therefore described further herein. Such "animation" can be defined to include a sequenced illumination of still images, wherein the selected animation of the still images provide the illusion of movement. The animation can relate to the use, consumption, or characteristics of one or more products within the associated vending machine 34, although this need not necessarily be the case. In some embodiments, the animation (however simple) is employed primarily to advertise or otherwise attract attention to the vending machine 34 or products used therein.

Figure 2:
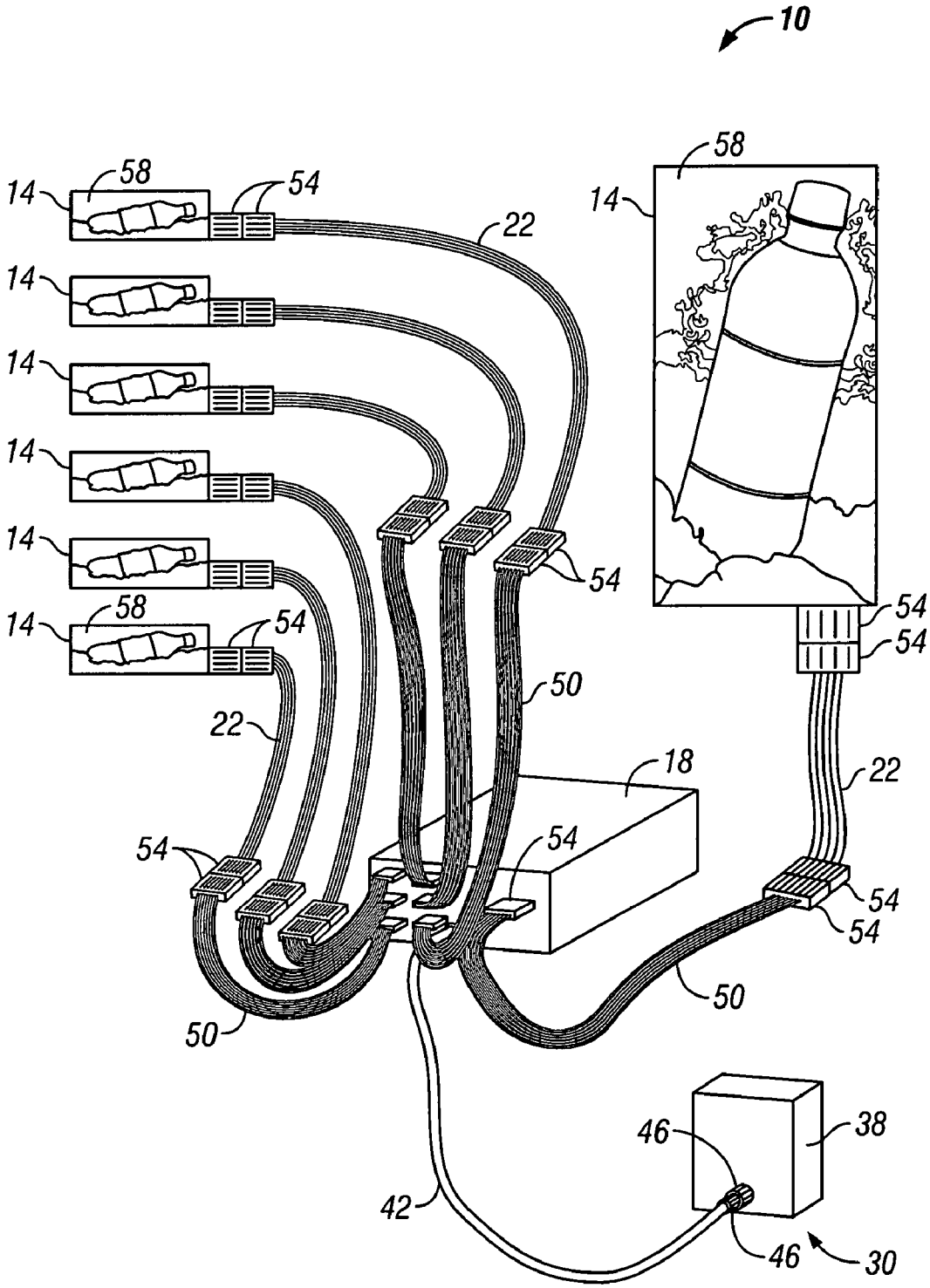
FIG. 2 is a schematic view of a vending machine advertising apparatus according to a second embodiment of the present invention.

In some embodiments, and as shown in FIG. 1, multiple wire leads 26 extend from a main power wire 22 to individual displays 14 in order to reduce the amount of wiring of the display apparatus 10, wherein the main power wire 22 transfers the power from the controller 18 to the multiple wire leads 26, and thereby to the EL displays 14. In such cases, the main power wire 22 can be defined by one or more leads 26 that branch to multiple displays 14 (in which case a control signal sent by the controller 18 can be transmitted to multiple displays 14 simultaneously). Alternatively, as shown in FIG. 2, each display 14 can be individually connected to the controller 18 via an individual power wire 22 and can be independently controlled by the controller 18. In such embodiments, each display 14 can be illuminated and timed to operate independently of the others.

The power wires 22, 26 can take any conventional form capable of transmitting power from the controller 18 to the displays 14, including without limitation cable, wire, ribbon cable, and the like. In the illustrated embodiment, the main power wire 22 and multiple wire leads 26 comprise a thin, flexible, wire ribbon. Also, the main power wire 22 in the illustrated embodiment electrically connects to an intermediate wire 50, which is connected between the main power wire 22 and the controller 18 via releasable connectors 54, wherein the intermediate wire 50 electrically connects to the controller 18 via the releasable connector 54. The intermediate wire 50 can take any conventional form as described above with reference to the other power wires 22, 26, and in the illustrated embodiment is comprised of a thin, flexible, and insulated multiple conductor wire. Alternatively, the thin, flexible, insulated multiple conductor wire comprises the main power wire 22 and multiple wire leads 26, in addition to the intermediate wire 50.

The use of an intermediate wire 50, although not required to connect the main power wire(s) to the controller 18, can provide significant advantages to the installation of the apparatus in the vending machine, and can enable quick installation and removal of the assembly defined by the power wire(s) and displays 14 as a single unit. Accordingly, the sub-assembly of the present invention defined by the displays 14 and power wires 22 can provide significant advantages over conventional vending machine advertising devices that require on-site installation and removal of multiple parts and components to install, service, and replace a comparable structure (e.g., buttons, bulbs, displays, wiring, etc.). Of course, embodiments of the present invention not employing intermediate wires 50 as just described can provide similar advantages.

Figure 3A:
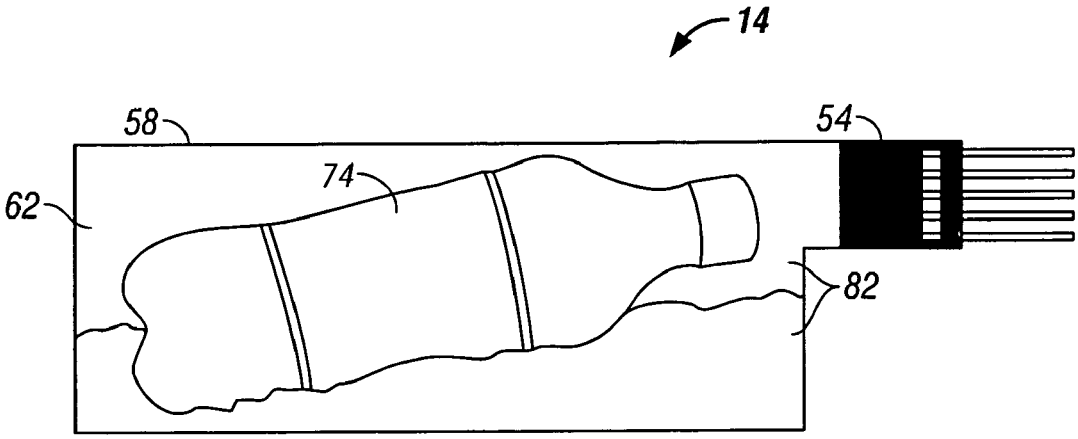
FIG. 3A is a front view of an EL display of the vending machine advertising apparatus illustrated in FIG. 1.
Figure 3B:
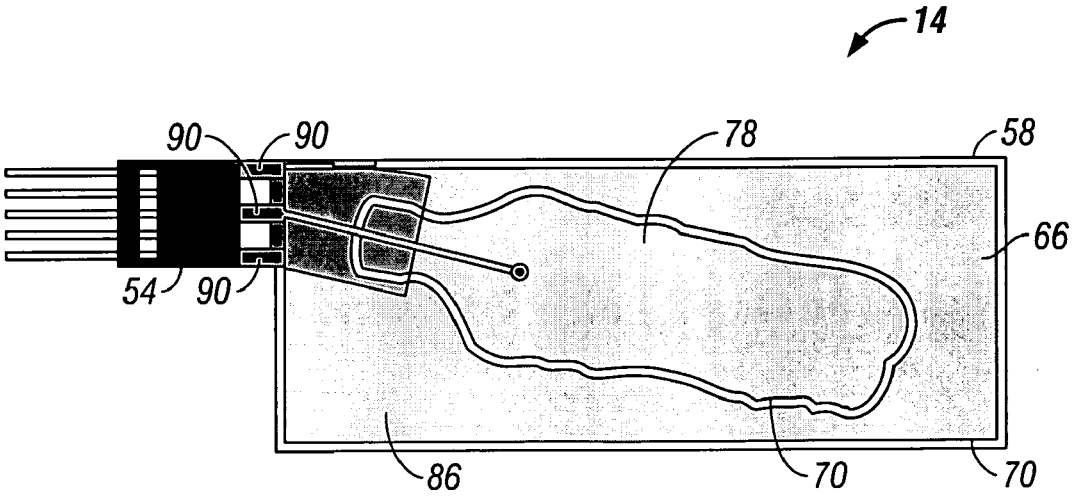
FIG. 3B is a rear view of the EL display illustrated in FIG. 3A.

With reference to FIGS. 3A and 3B, in some embodiments the EL displays 14 each include a thin, flexible panel 58 having a still image 62 on one side of the panel 58. Depending at least in part upon the display application upon the vending machine 34, the displays 14 are between about 0.2 mm and 0.5 mm thick. Also, in some embodiments a thin film 66 of phosphorous is adhered to the other side of the panel 58, and the panel 58 is laminated for protection of the phosphorous. Alternatively, relatively stiff and non-flexible EL displays 14 can be used, rather than the thin, flexible panels 58 just described. The thin film 66 of phosphorous can be applied to the panel 58 in multiple portions 70 to electrically isolate the portions 70 from each other. As a result, different portions 70 can be illuminated separately from other portions 70. The portions 70 correlate with the still image 62 on the front of the EL display 14. As shown in FIGS. 3A-3B by way of example only, a bottle image 74 correlates with a first portion 78, while a background image 82 correlates with a second portion 86. Alternatively, more than two portions 70 can be utilized in the EL display 14. For example, the EL display 14 can have portions 70 that correlate with the bottle image 74 and multiple background images 82 to provide further animation possibilities. A further alternative includes only using one segment 70 on the EL display 14, such that when the segment 70 is illuminated, the part or all of the entire still image 62 on the EL display 14 illuminates.

In some embodiments, the main power wire 22 and multiple wire leads 26 include multiple conductors 90, each of which control one or more areas of at least one display 14. As shown in FIG. 3B, the multiple conductors 90 electrically connect to respective portions 70 of the display 14 to provide power to those portions 70. Each conductor 90 can be used to illuminate a portion 70 of the EL display 14. For example, the conductors 90 can be used to illuminate the areas of the EL display 14 having a particular color or location on the display 14 (such as one conductor 90 for illuminating all white display areas, one for illuminating all red areas, and the like). The various conductors 90 defining the power wire 22 and wire leads 26 therefore can be controlled by the controller 18 in a conventional manner to generate animation on the EL displays 14 by supplying power to such portions 70 of the EL displays 14 in a timed, patterned, or other manner.

The EL displays 14 can be permanently connected to their respective leads 26. Alternatively however, the EL displays 14 can be connected to their respective leads 26 with releasable connectors 54, enabling quick and easy removal and replacement of EL displays 14 (e.g., for purposes of replacing damaged displays 14, updating EL displays 14 with new product advertisements from time to time, or switching locations of EL displays 14 on the same vending machine 34). As shown in FIGS. 3A and 3B, the releasable connectors 54 can directly attached or mounted to the individual EL displays 14, or can be located anywhere between the displays 14 and the controller 18 as desired, thereby enabling a user to selectively remove and/or install one or more EL displays from the apparatus 10. Also, as previously stated with regard to some embodiments, the wire ribbon comprising the main power wire 22 can electrically connect to a thin, flexible, and insulated multiple conductor wire comprising the intermediate wire 50 via a releasable connector 54, wherein the intermediate wire 50 electrically connects to the controller 18 via a releasable connector 54. Each wire lead 26 can connect with any design, size, or shape of EL display 14, or can be left disconnected as desired.

Figure 4A:
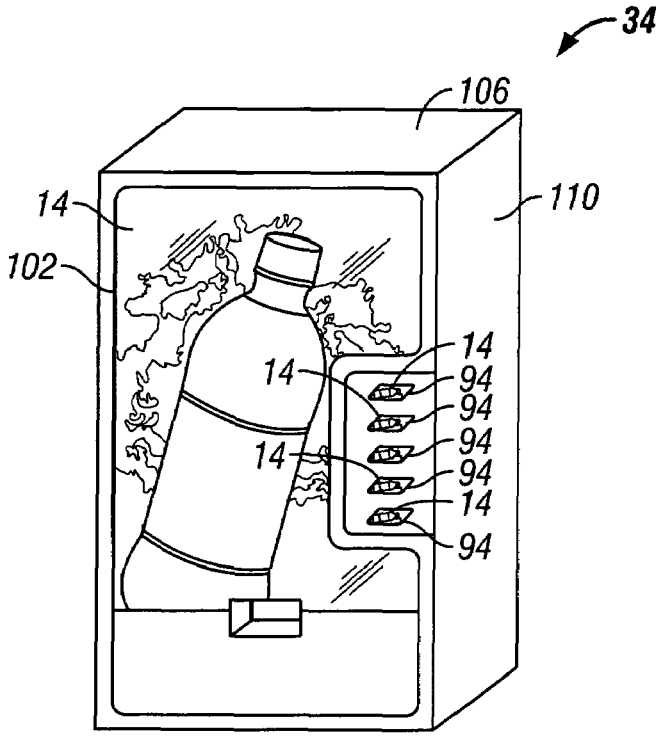
FIGS. 4A-4D are perspective views of vending machines utilizing vending machine advertising apparatuses according to various embodiments of the present invention.
Figure 4B:
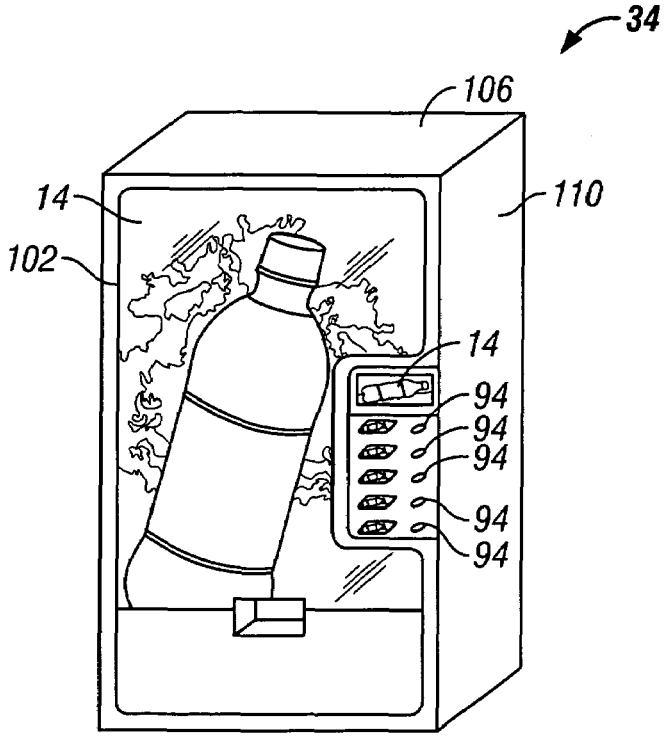

The EL displays 14 can be in a variety of sizes and shapes. FIG. 4A illustrates a display apparatus 10 having multiple EL displays 14 that are planar in shape, thin, flexible, and located within transparent or semi-transparent product buttons 94 of the vending machine 34. In some embodiments, these product buttons 94 define a sleeve or receptacle within which can be received conventional displays. Accordingly, the EL displays 14 can be received within the same locations in which the conventional displays are received, thereby enabling quick and easy installation of the apparatus 10 in existing vending machines 34 or in new vending machines with conventional designs. Although flexible EL displays can enable easier installation and removal of the EL displays in the buttons 94, non-flexible EL displays can instead be employed in some cases. In alternative embodiments, a singular, general EL display 14 can be employed (rather than or in addition to multiple EL displays 14 each associated with one or more product buttons 94), or a display 14 can be associated with two or more product buttons 94, as shown in FIG. 4B.

Figure 4C:
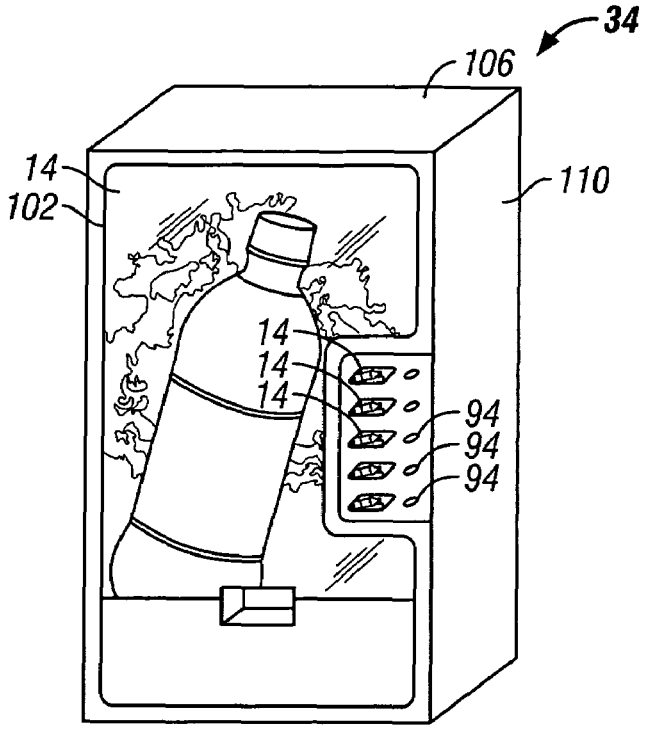
Figure 4D:
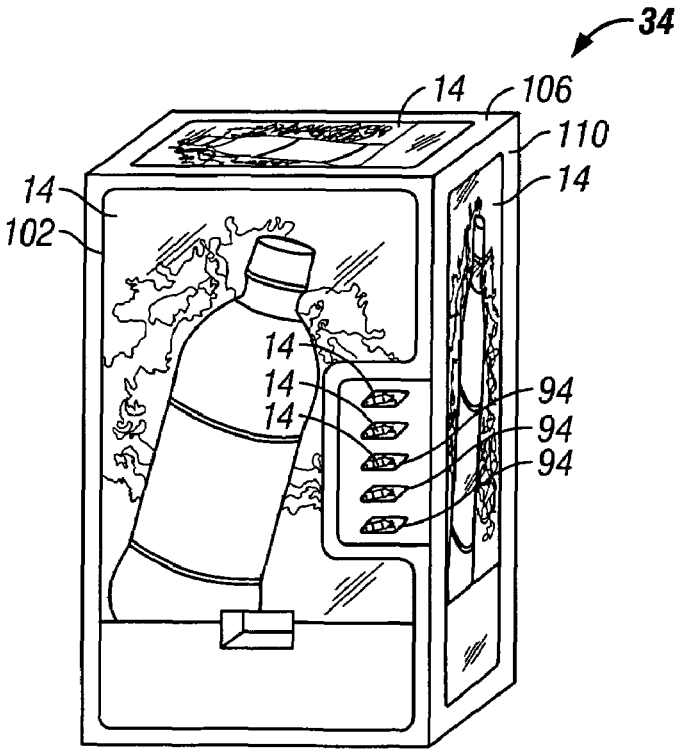

As mentioned above, in some embodiments (see FIG. 4A) the display apparatus 10 employs individual EL displays 14 used as display inserts in product buttons 94 such as those found in many conventional vending machines 34. To insert an EL display 14 into the product button 94, the button 94 can be removed or opened so that the EL display 14 can be inserted therein. In some cases, and as shown in FIG. 4C, the EL display 14 can be secured in any conventional manner within, behind, or on top of the product button. Although the displays 14 are attached or otherwise located at each button 94 in some embodiments, the EL displays 14 can instead be located proximate the product buttons 94, including adjacent to, above, or below a corresponding product button 94, and can be attached to the vending machine 34 using adhesive or cohesive bonding material, tape, clips, pins, screws, or other conventional fasteners, by sandwiching the EL displays 14 between panels near each button 94 (using transparent cover panels to permit visibility of the displays 14), and the like. As shown in FIGS. 4A-4D, one or more EL displays 14 can be utilized on the front panel 102 of the vending machine 34, and can be placed and secured directly upon a surface of the front panel 102 of the vending machine 34 by using any of the methods just described—even without modification of the surface to which the EL displays 14 are attached. As shown in FIG. 4D, one or more EL displays can be placed and secured to any viewable surface of the vending machine 34, including the top surface 106 and side surfaces 110 of the vending machine 34. In some embodiments, the EL displays can even define a front, top, or side of the vending machine 34.

Figure 5A:
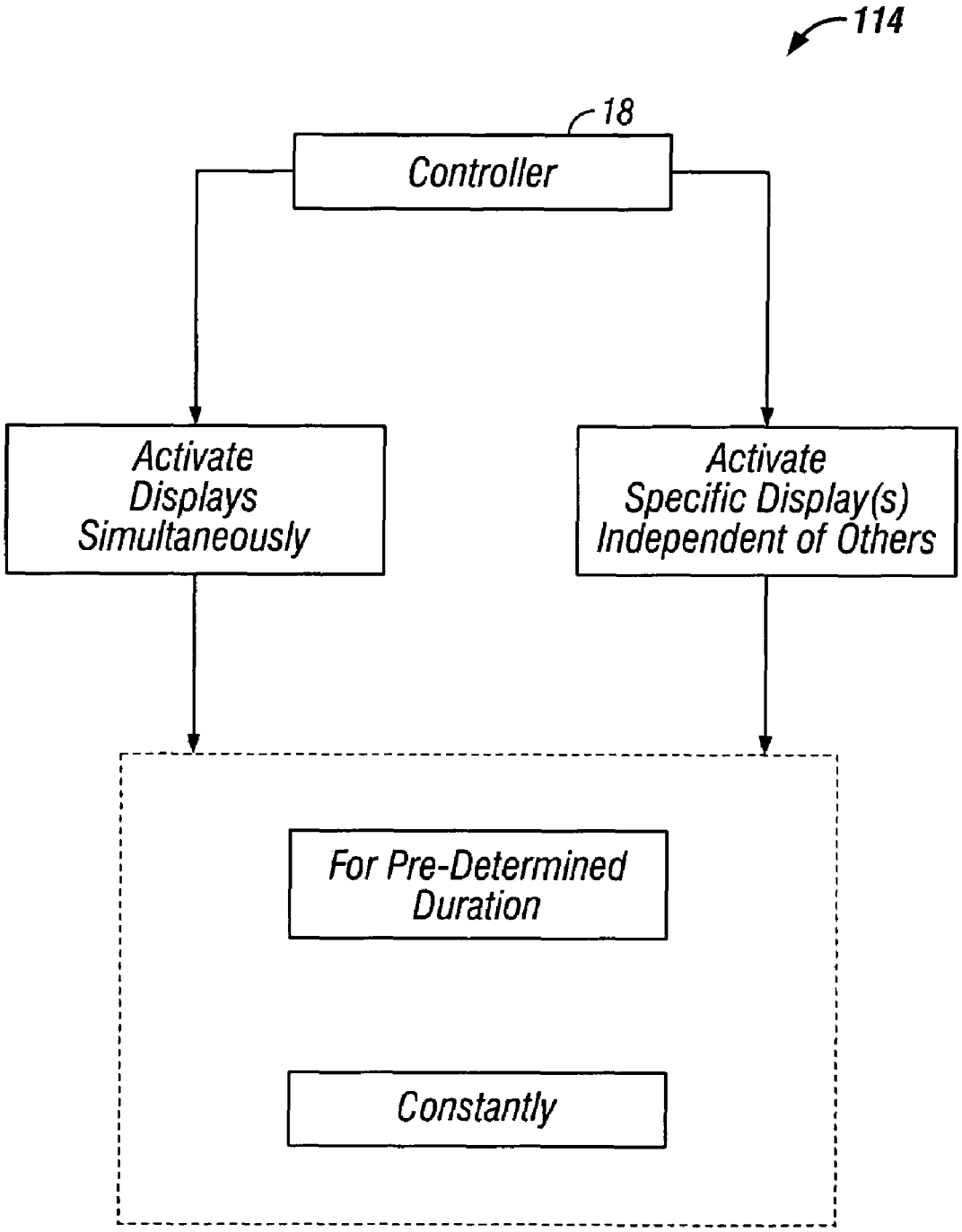
FIG. 5A is a flowchart illustrating a vending machine advertising method according to one embodiment of the present invention.

Functionally, the EL displays 14 can be configured to operate (illuminate) in a number of different manners, including being responsive or non-responsive to user manipulation of buttons 94 or other controls (not shown) of the vending machine 34. As shown in FIG. 5A, one type of non-responsive EL display 14 operation includes a first configuration 114 where the EL displays 14 are powered by the controller 18 and operate constantly without any user prompting or interaction. In such embodiments, no electrical connection between any user-manipulatable control on the vending machine 34 and the displays 14 necessarily exists. Also shown in FIG. 5A, another type of non-responsive EL display operation includes powering and controlling the EL displays 14 for a pre-determined duration (e.g., governed by a timer, clock, or the like) so that the EL displays 14 turn on and off without any user interaction, such as at certain times of day, for periods of time, etc.

Figure 5B:
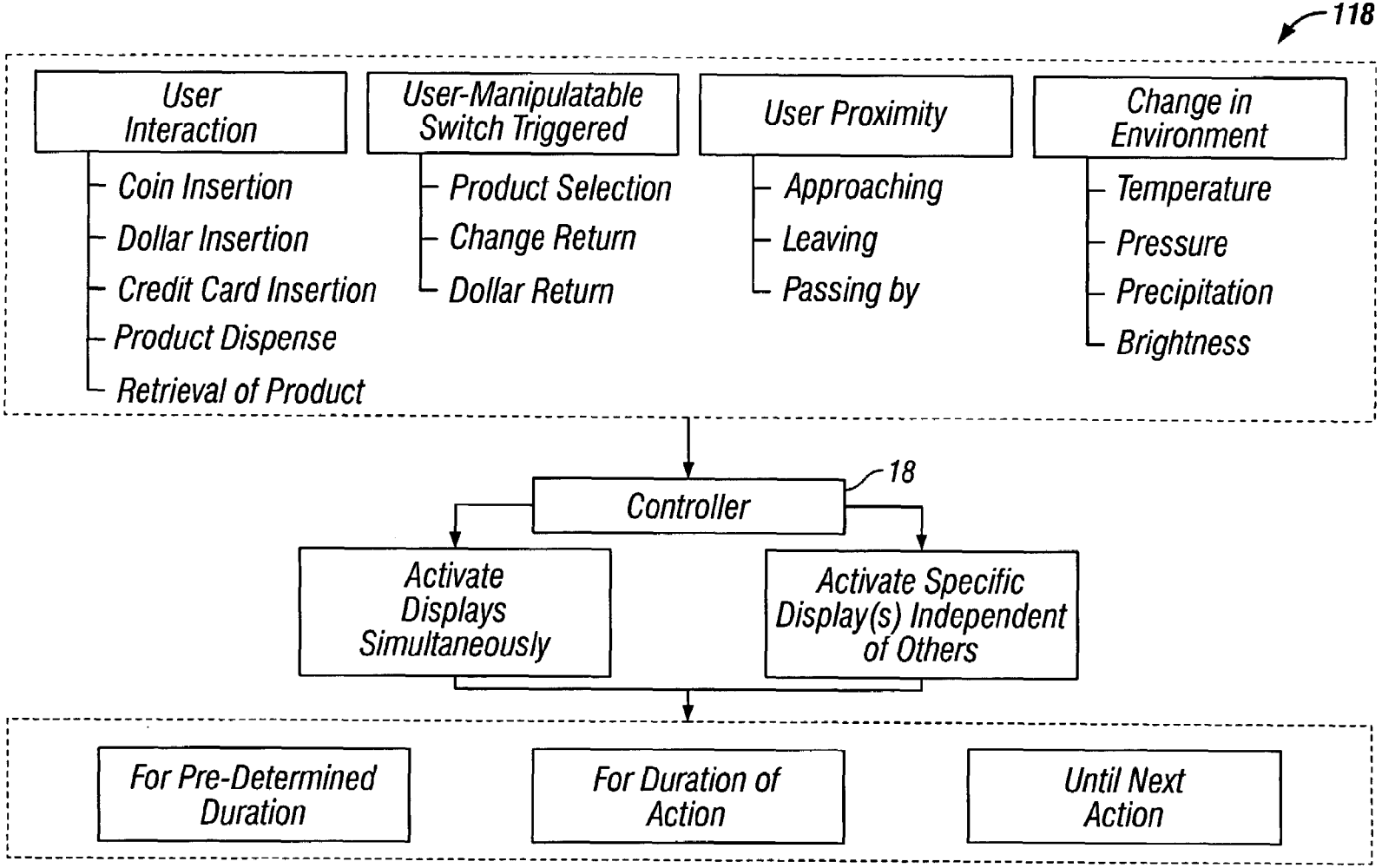
FIG. 5B is a flowchart illustrating a vending machine advertising method according to another embodiment of the present invention.

As mentioned above, the EL displays 14 can instead be configured to be responsive in one or more manners to user prompting or interaction with the vending machine 34, as shown in other configurations 118 illustrated in FIG. 5B. More specifically, the controller 18 could be responsive to a signal from any user-manipulatable control on the vending machine 34 by sending one or more signals to one or more of the EL displays 14. In such embodiments, the EL displays 14 can be responsive to any one or more of the following user interactions: coin insertion, dollar insertion, credit card insertion, product dispense or retrieval (e.g., detected by one or more conventional mechanical switches, pressure plates, sensors, and the like). The EL displays 14 can also or instead be responsive to any button, lever, knob, dial, switch, or other user manipulatable control, including product selection controls, change return controls, and money return controls, among others. Also, one or more conventional sensors can be connected to the controller 18 to respond to user proximity, such as when the user is approaching, leaving, or is detected within a distance of the vending machine 34. The EL displays 14 could also or instead be responsive to environmental changes or states, such as changes in temperature, pressure, precipitation, and brightness, using appropriate sensors, such as thermocouples, pressure sensors, barometers, and photosensors, respectively.

For example, the controller 18 can be responsive to a temperature sensor (on or within the vending machine 34 and coupled to the controller 18) to trigger operation of one or more EL displays 14 above a certain temperature, such as to advertise beverages. As another example, the controller 18 can be responsive to a light sensor (on or within the vending machine 34 and coupled to the controller 18) to trigger operation of one or more EL displays 14 only when sufficient darkness is detected. Additionally, the sensors, working in conjunction with the controller 18, may conserve energy be deactivating the displays 14 during certain conditions measured by the sensors. For example, the photosensor, in conjunction with the controller 18, may trigger the controller 18 to deactivate the displays 14 when a certain level of brightness is measured around the vending machine 34. As a result, energy can be conserved by deactivating the displays 14 during conditions when the displays 14 are least likely to be seen or when the use of the displays 14 is most effective.

The EL displays 14 can also be controlled by the controller 18 to operate differently depending at least in part upon the operational mode of the vending machine 34, such as during pre-sale, sale, and post-sale modes of the vending machine 34. For example, during pre-sale operation, the EL displays 14 could be used to advertise and to attract consumers to the vending machine 34, such as by providing animation on the displays 14 in a pattern, in succession, simultaneously, or in any other manner. As another example, during a sale mode (e.g., after deposit of money into the vending machine 34 or upon prompt by a user by manipulating a vending machine control), the displays 14 could be controlled in a different manner, such as by lighting or animating only a display 14 associated with a control that has been pushed or otherwise manipulated by a user. As yet another example, during a post-sale mode of the vending machine 34, an individual EL display 14 or multiple EL displays 14 can display images regarding the product purchased, gratitude for the product purchased, and other products for sale. These images can be still graphics, graphic animation, or a text message to the consumer in any of the forms described herein. It should be noted that the EL displays 14 can be configured to operate in a responsive or non-responsive manner depending upon whether the vending machine 34 is in pre-sale mode, sale mode, or post-sale mode.

Advertising can be displayed by either an individual EL display 14, by multiple EL displays 14, or by combinations of EL displays 14 operating in a coordinated manner to present any type of advertisement. Such advertising can be presented in a variety of different formats. For example, advertising can take the form of still graphics, graphic animation, a still or animated text message to consumers or potential consumers, and the like. If desired, animation can include sequenced illumination of still images 62 depicting the product, product use, product users or consumers, product consumption, or other subjects. Text messages can include words or phrases relating to product cost and availability, product descriptions, advertising slogans, and other information. Animated graphics or text can repeat or can be presented over time in any other manner in order to convey product information and/or to attract customers.

In some preferred embodiments, when a product button 94 (or other user-manipulatable control associated with a product in the vending machine 34) is operated in a sale mode of the vending machine 34, information relating to that product is displayed by either an individual EL display 14 associated with the product button 94 or by multiple EL displays 14. This information can be presented in any of the formats described above. In those embodiments employing displays 14 that are associated with and responsive to user-manipulatable controls (e.g., a display 14 associated with and responsive to manipulation of a corresponding control), the controls can take any conventional form, including levers, switches, touch-screens, toggle switches, and pull knobs.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

We claim:

1. A vending machine display apparatus for a vending machine having user-manipulatable controls for dispensing products, the vending machine display apparatus comprising:

a controller;

at least two displays electrically and releasably coupled to the controller and adapted to be coupled to the vending machine in respective locations externally visible on the vending machine, wherein each respective location is one of within and behind a user manipulatable control of the vending machine, each display removable independently of the other displays; and at least one power line coupled to the displays and adapted to supply power to the displays;

the displays associated with the user-manipulatable controls and with products in the vending machine dispensed by operation of the user-manipulatable controls, the displays responsive to the controller by changing at least one of graphics and text displayed by the displays.

2. The vending machine display apparatus as claimed in claim 1, wherein the display is a light emitting diode display.

3. The vending machine display apparatus as claimed in claim 1, wherein at least one of the displays is coupled to and removable from a respective user-manipulatable control.

4. The vending machine display apparatus as claimed in claim 3, wherein the at least one of the displays is releasably coupled to and removable from the respective user-manipulatable control.

5. The vending machine display apparatus as claimed in claim 1, wherein at least one of the user-manipulatable controls is a button.

6. The vending machine display apparatus as claimed in claim 1, wherein at least one of the displays is responsive to operation of a corresponding user-manipulatable control to change at least one of graphics and text displayed by the at least one of the displays.

7. The vending machine display apparatus as claimed in claim 1, wherein the displays are interchangeable with other displays displaying different advertisements.

8. The vending machine display apparatus as claimed in claim 1, wherein the displays are substantially planar.

9. The vending machine display apparatus as claimed in claim 1, wherein the controller controls at least one of the displays to generate animation in one manner prior to operation of a corresponding user-manipulatable control and in another manner after operation of the corresponding user-manipulatable control.

10. The vending machine display apparatus as claimed in claim 1, wherein the displays display information regarding the products associated with the user-manipulatable controls.

11. A vending machine display apparatus for a vending machine having a plurality of user-manipulatable controls, each user-manipulatable control operable to generate dispense of a product associated with the user-manipulatable control, the vending machine display apparatus comprising:

a plurality of displays each adapted to be removably coupled to the vending machine in respective locations independently of the other displays, wherein each respective location is one of within and behind a respective user manipulatable control of the vending machine;

at least one controller releasably coupled to the plurality of displays, the at least one controller operable to generate animation upon the plurality of displays, at least two of the displays individually controllable by the at least one controller; and a plurality of power lines electrically coupled to the plurality of displays.

12. The vending machine display apparatus as claimed in claim 11, wherein at least one of the plurality of displays is coupled to at least one of the plurality of user-manipulatable controls.

13. The vending machine display apparatus as claimed in claim 12, wherein at least one of the plurality of displays is releasably coupled to and removable from at least one of the plurality of user-manipulatable controls.

14. The vending machine display apparatus as claimed in claim 12, wherein at least one of the plurality of user-manipulatable controls is a button.

15. The vending machine display apparatus as claimed in claim 12, wherein at least one of the plurality of displays is responsive to operation of at least one of the plurality of user-manipulatable controls to change at least one of graphics and text displayed by the at least one display.

16. The vending machine display apparatus as claimed in claim 11, wherein at least one of the plurality of displays is interchangeable with other displays displaying different advertisements.

17. The vending machine display apparatus as claimed in claim 11, wherein at least one of the plurality of displays is substantially planar.

18. The vending machine display apparatus as claimed in claim 11, wherein at least one of the plurality of controllers controls at least one of the plurality of displays to generate animation in one manner prior to operation of at least one of the plurality of user-manipulatable controls and in another manner after operation of the at least one user-manipulatable control.

19. The vending machine display apparatus as claimed in claim 11, wherein at least one of the plurality of displays displays information regarding the product associated with at least one of the plurality of user-manipulatable controls.

20. A method of advertising products in a vending machine, the method comprising:

supplying power to at least one display releasably coupled to a controller of the vending machine, each display associated with a corresponding user-manipulatable control on the vending machine;

coupling each display to one of a location within the corresponding user-manipulatable control and behind the corresponding user-manipulatable control, each display individually removable from its location;

controlling a supply of power to the at least one display via the controller; and individually controlling each display to generate animation thereon by controlling the supply of power thereto, the animation including an advertisement for a product dispensed by operation of the corresponding user-manipulatable control.

* * * * *